US007246454B2

(12) United States Patent
Kramer

(10) Patent No.: US 7,246,454 B2
(45) Date of Patent: Jul. 24, 2007

(54) INSOLES WITH SHOCK ABSORPTION FLEXIBLE MATERIAL

(76) Inventor: Hy Kramer, 1457 Bassett Ave., Bronx, NY (US) 10461

( * ) Notice: Subject to any disclaimer, the term of this patent is extended or adjusted under 35 U.S.C. 154(b) by 0 days.

(21) Appl. No.: 11/265,014

(22) Filed: Nov. 3, 2005

(65) Prior Publication Data

US 2007/0094895 A1 May 3, 2007

(51) Int. Cl.
*A43B 13/40* (2006.01)

(52) U.S. Cl. ..... 36/44; 36/28; 36/30 R

(58) Field of Classification Search ..... 36/30 R, 36/138, 28, 31, 43, 44, 141
See application file for complete search history.

(56) References Cited

U.S. PATENT DOCUMENTS 889,093 A * 5/1908 Bemis ..... 36/44
1,208,638 A * 12/1916 Phillips ..... 36/44
4,941,273 A * 7/1990 Gross ..... 36/114
5,369,896 A * 12/1994 Frachey et al. ..... 36/28
5,619,809 A * 4/1997 Sessa ..... 36/28
5,935,671 A * 8/1999 Lhuillier ..... 36/43
6,006,447 A * 12/1999 Neal et al. ..... 36/44
6,976,319 B2 * 12/2005 Pfander ..... 36/30 R
2003/0150131 A1 * 8/2003 McManus et al. ..... 36/28
2004/0088883 A1 * 5/2004 Workman ..... 36/15
2005/0274042 A1 * 12/2005 Issler ..... 36/15

* cited by examiner

*Primary Examiner*—Ted Kavanaugh

(57) ABSTRACT

An insole comprising an upper foot contacting substrate, a lower substrate, and a shock absorbing flexible substrate with a plurality of cylinders and a plurality of carrying strips. The strips are trapped between the upper and lower substrates.

1 Claim, 1 Drawing Sheet

INSOLES WITH SHOCK ABSORPTION FLEXIBLE MATERIAL

BACKGROUND OF INVENTION

The present invention is an improvement of prior application Ser. No. 07/477,732 (abandoned) and U.S. Pat. No. 5,233,767 issued to the present inventor and relates to improvement of articles of insoles pertaining to footwear in the footwear industry.

In the field of Insoles the general procedure is to have shock absorbers used by themselves. In searching the industry the inventor was unable to find where shock absorption flexible material is applied to a carry strip and then trapped between upper and lower substrates and had an opening in the bottom of the insole. In further search of the field the inventor did not find any system of assembling the shock absorbers to the insole, as described in this application. This invention is a new and innovative concept of Insoles.

OBJECT OF INVENTION

The object of this invention is to have a carry strip having shock absorber substrates. One of the substrates is illustrated in FIG. 2. The carry strip is placed on the bottom of the shock absorber substrate. It is understood that the carry strip can be located in various places within the shock absorber substrate to enable assembly. If it is desirable to use cylinders (18), they can be placed at the bottom, as shown in FIG. 2. The carry strip can be understood when viewing the attached drawing.

DESCRIPTION OF DRAWINGS

FIG. 2 shows one type of carry strip (15) and one type of shock absorption flexible material (18). FIG. 2 shows that the carry strip (15) is at the bottom of the shock absorber substrate (18). To further clarify the location of the carry strip (15), it can be placed on the top, on the bottom or somewhere in between the substrate. For further clarification, FIG. 2 is an exploded view of FIG. 4.

FIG. 3 is a covering substrate. The substrate generally comes in contact with the foot of the wearer.

DESCRIPTION OF ASSEMBLY

Figure 5:
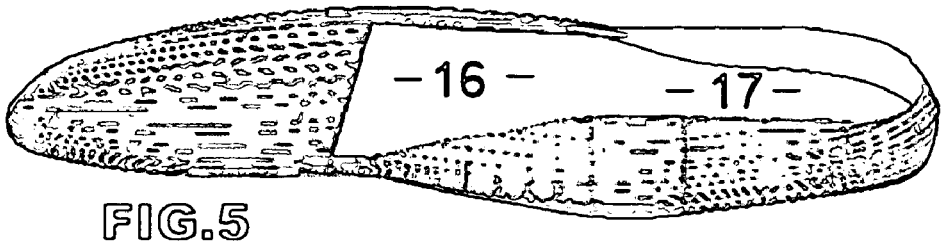
FIG. 5 is the bottom of an insole that generally comes in contact with the shoe of the wearer. It is understood that the openings can consist of one or more openings, as described by (16) (17). When combining FIGS. 3, 4 and 5 you end up with FIG. 1 where
Figure 4:
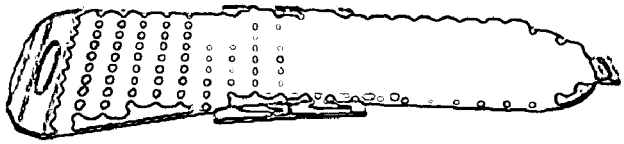
FIG. 4 is the combination of a carry strip (15) and shock absorption flexible material that is trapped between FIGS. 3 and 5 substrates when a large opening (16) (17) is used, to expose the shock absorption flexible material as illustrated in FIG. 1.
Figure 3:
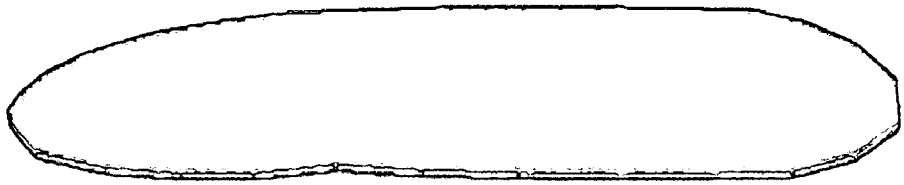
FIG. 3 is hidden.
Figure 2:
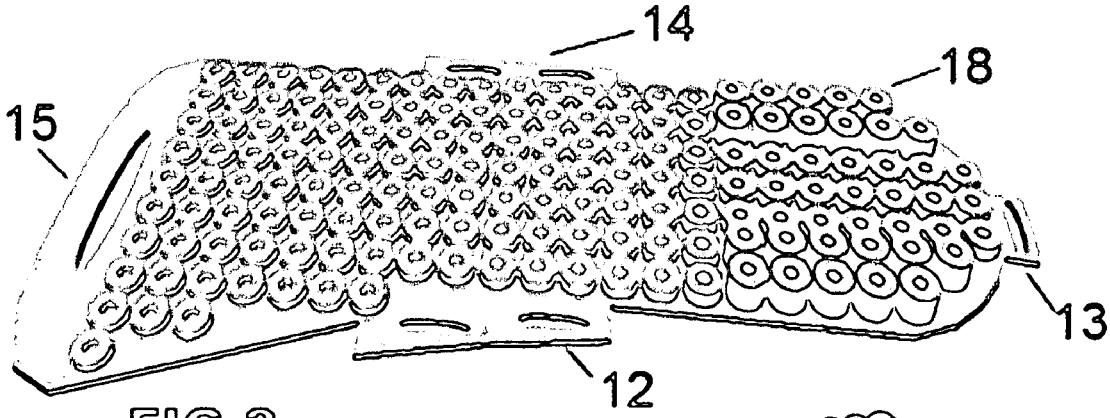
FIG. 2 is an exploded view of FIG. 4 and illustrates the carry strip (12,13,14,15; for simplification the carrying strip is designated to show one application bearing in mind that one of the substrates (18) is only for illustration purposes. Other shock absorption flexible material substrates can be used in various shapes and the carry strip can be located in various places within the shock absorbing substrates. A substrate can be made from plastic, rubber or other flexible material—or other combinations.
Figure 1:
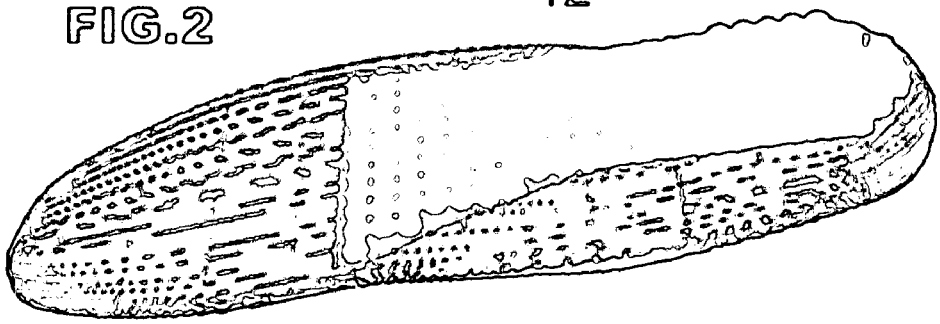
FIG. 1 is a completely assembled insole made up of FIGS. 3, 4 and 5.

To assemble insert carry strip with shock absorption flexible material (FIG. 4) into the bottom of the insole (FIG. 5) and cover it with the covering substrate (FIG. 3).

Since the invention is described and illustrated with reference to but a single preferred embodiment, and since numerous modifications and changes may become readily apparent to those skilled in the art after reading this disclosure, it should be understood that I do not wish to limit the scope of my invention to the exact construction shown and described above, and as claimed by me following.

I claim:

1. An insole comprising:

an upper foot contacting substrate;

a lower substrate having a top surface and a bottom surface, at least one large opening extending through the surfaces including an arch and heel area, said lower substrate having a shape corresponding to a periphery of the wearer's foot; and a shock absorbing flexible substrate having a top surface and a bottom surface, sandwiched between the upper and lower substrates, said shock absorbing substrate comprising a plurality of downwardly protruding cushioning cylinders extending over a majority of the bottom surface and a plurality of carrying strips extending outwardly from a periphery of the top surface, said plurality of cushioning cylinders extending through said opening of the lower substrate to expose the plurality of cylinders, said carrying strips extending over the top surface of the lower substrate, and said strips trapped between the top covering substrate and the bottom substrate.

* * * * *